US009309843B2

(12) United States Patent
Hwang et al.

(10) Patent No.: US 9,309,843 B2
(45) Date of Patent: Apr. 12, 2016

(54) RESONATOR FOR VEHICLE

(71) Applicant: LS Mtron Ltd., Anyang-si, Gyeonggi-do (KR)

(72) Inventors: Ho Jun Hwang, Anyang-si (KR); Jung Uk Lee, Seoul (KR)

(73) Assignee: LS MTRON LTD., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/618,852

(22) Filed: Feb. 10, 2015

(65) Prior Publication Data

US 2015/0226163 A1 Aug. 13, 2015

(30) Foreign Application Priority Data

Feb. 13, 2014 (KR) ..... 10-2014-0016722
Feb. 13, 2014 (KR) ..... 10-2014-0016724
Aug. 5, 2014 (KR) ..... 10-2014-0100471

(51) Int. Cl.
*F02M 35/12* (2006.01)
*F02M 35/10* (2006.01)

(52) U.S. Cl.
CPC ..... *F02M 35/1255* (2013.01); *F02M 35/1036* (2013.01); *F02M 35/1211* (2013.01); *F02M 35/1216* (2013.01); *F02M 35/1227* (2013.01); *F02M 35/1233* (2013.01); *F02M 35/1266* (2013.01)

(58) Field of Classification Search
CPC ..... F02M 35/12
USPC ..... 181/229, 227, 228, 212, 247, 266, 282; 123/184.53, 184.57
See application file for complete search history.

(56) References Cited

U.S. PATENT DOCUMENTS

| | | | | |
|---|---|---|---|---|
| 2,014,368 | A | 9/1935 | Blundell | |
| 2,166,417 | A | 7/1939 | Manning | |
| 3,903,928 | A * | 9/1975 | Sykes et al. | 138/109 |
| 4,315,558 | A * | 2/1982 | Katayama | 181/227 |
| 4,854,416 | A * | 8/1989 | Lalikos et al. | 181/207 |
| 5,839,405 | A | 11/1998 | Falkowski et al. | |
| 5,901,754 | A * | 5/1999 | Elsasser et al. | 138/118 |
| 6,938,601 | B2 * | 9/2005 | Fukumoto | 123/184.57 |
| 7,367,424 | B2 * | 5/2008 | Brown et al. | 181/250 |

(Continued)

FOREIGN PATENT DOCUMENTS

| | | | |
|---|---|---|---|
| EP | 2067979 | A1 | 6/2009 |
| KR | 10-2006-0116275 | A | 11/2006 |

(Continued)

OTHER PUBLICATIONS

European Search Report for European Patent Application No. 15154559.7.

*Primary Examiner* — Forrest M Phillips
(74) *Attorney, Agent, or Firm* — LRK Patent Law Firm

(57) ABSTRACT

A resonator for a vehicle, which reduces intake noise by using a resonance chamber for frequency tuning, includes an outer pipe having a first outer pipe with an inlet for introducing external air and a second outer pipe with an outlet for discharging the air introduced into the inlet to outside, an inner pipe disposed inside the outer pipe and having a plurality of slits for giving a passage of air, and an expansion pipe inserted between the outer pipe and the inner pipe to partition a space between the outer pipe and the inner pipe into a plurality of spaces and thus partition the resonance chamber into a plurality of regions.

12 Claims, 14 Drawing Sheets

(56) References Cited

U.S. PATENT DOCUMENTS

| | | | | |
|---|---|---|---|---|
| 7,448,469 | B2 * | 11/2008 | Seyler et al. | 181/249 |
| 7,934,581 | B2 * | 5/2011 | Kim et al. | 181/250 |
| 8,177,024 | B2 * | 5/2012 | Caliskan | 181/250 |
| 8,348,012 | B2 * | 1/2013 | Hwang | 181/229 |
| 2002/0104707 | A1 * | 8/2002 | Moffat et al. | 181/249 |
| 2007/0107982 | A1 * | 5/2007 | Sullivan | 181/249 |
| 2007/0240932 | A1 * | 10/2007 | Van De Flier et al. | 181/228 |
| 2008/0196969 | A1 * | 8/2008 | Henke et al. | 181/212 |
| 2009/0014235 | A1 * | 1/2009 | Troxler | 181/228 |
| 2010/0193282 | A1 * | 8/2010 | Kim et al. | 181/229 |
| 2014/0196978 | A1 * | 7/2014 | Hartmann | 181/229 |

FOREIGN PATENT DOCUMENTS

| | | | |
|---|---|---|---|
| KR | 10-2009-0047083 | A | 5/2009 |
| KR | 10-2011-0007460 | A | 1/2011 |
| KR | 10-2011-0048931 | A | 5/2011 |
| KR | 10-2011-0062253 | A | 6/2011 |
| KR | 10-2011-0062345 | A | 6/2011 |
| KR | 10-2011-0110599 | A | 10/2011 |

* cited by examiner

RESONATOR FOR VEHICLE

CROSS-REFERENCE TO RELATED APPLICATION

This application claims priority to Korean Patent Application No. 10-2014-0016722 filed on Feb. 13, 2014, No. 10-2014-0016724 filed on Feb. 13, 2014 and No. 10-2014-0100471 filed on Aug. 5, 2014, and all the benefits accruing, therefrom under 35 U.S.C. §119, the contents of which in its entirety are herein incorporated by reference.

BACKGROUND

1. Field

The present disclosure relates to a resonator for a vehicle, and more particularly, to a resonator for a vehicle, in which a plurality of resonance chambers are formed between an outer pipe configuring an outward appearance and an inner pipe disposed inside the outer pipe to improve noise reduction performance of the resonator.

2. Description of the Related Art

Generally, an intake system of a vehicle includes an air cleaner, a turbo-charger, an inter-cooler, an air duct and an engine manifold, and an external air introduced into an internal combustion engine by the intake system is repeatedly expanded and shrunken to cause intake pulsation. The intake pulsation causes noise due to the change of air pressure, and particularly, greater noise is caused due to air resonance of a vehicle body or an indoor space of the vehicle.

In order to restrain the intake noise, a resonator for tuning the intake system into a specific frequency is installed at an intake hose which connects the air cleaner to the intake manifold.

As an example of existing resonators, Korean Patent Publication No 2006-0116275 discloses a resonator, which includes an outer pipe configuring an outward appearance and an inner pipe installed in the outer pipe to give an air passage. A resonance chamber for tuning air frequency to reduce noise is formed in a space between the outer pipe and the inner pipe, and a slit for guiding air to the resonance chamber is formed at the inner pipe. In other words, the air flowing into the inner pipe moves to the resonance chamber through the slit, and the air moving to the resonance chamber may experience frequency tuning, thereby performing noise reduction of the air.

However, this resonator has a limit in the number of resonance chambers, and thus the frequency tuning work for external air cannot be performed over a broad band. In other words, since the resonator has a limited number of resonance chambers, the degree of frequency tuning freedom is low, and thus the noise reduction for external air is not performed agreeably.

Korean Patent Publication No. 2009-0047083 discloses a resonator in which a first duct and a second duct with different sectional areas are disposed therein, and a length of a region where two ducts overlap with each other is adjusted to reduce noise of a specific frequency. However, in spite of this technique, the number of resonance chambers for noise reduction is still limited, and thus it is not easy to reduce noise of a broad band. In particular, a turning work at a high frequency band is not easy, and thus noise reduction efficiency for external air is low.

SUMMARY

The present disclosure is directed to providing a resonator for a vehicle, which may enhance the degree of frequency tuning freedom for air introduced into a resonance chamber by forming a plurality of resonance chambers between an outer pipe and an inner pipe of the resonator.

In one aspect, there is provided a resonator for a vehicle, which reduces intake noise by using a resonance chamber for frequency tuning, the resonator including: an outer pipe having a first outer pipe with an inlet for introducing external air and a second outer pipe with an outlet for discharging the air introduced into the inlet to outside; an inner pipe disposed inside the outer pipe and having a plurality of slits for giving a passage of air; and an expansion pipe inserted between the outer pipe and the inner pipe to partition a space between the outer pipe and the inner pipe into a plurality of spaces and thus partition the resonance chamber into a plurality of regions.

According to the present disclosure, since an expansion pipe is inserted between an outer pipe and an inner pipe, the number of resonance chambers formed between the outer pipe and the inner pipe may increase, and thus the degree of frequency tuning freedom may also be enhanced.

In addition, since it is possible to increase the number of resonance chambers by inserting a plurality of expansion pipes between the outer pipe and the inner pipe as necessary, noise of various frequencies may be reduced.

Moreover, since the resonator is coupled in an assembling way, the number of resonance chambers may be easily increased or decreased.

In addition, since the outer pipe, the inner pipe and the expansion pipe are hermetically coupled by means of welding, leakage of external air may be prevented, and thus intake noise reduction efficiency may be maximized.

Moreover, since it is possible to increase the number of resonance chambers by inserting an intermediate pipe and a barrier between the outer pipe and the inner pipe as necessary, noise of various frequencies may be reduced.

DETAILED DESCRIPTION

Hereinafter embodiments of the present disclosure will be described in detail with reference to the accompanying drawings. Even though the present disclosure is described based on the embodiments depicted in, the drawings, the technical spirit, essential features or operations of the present disclosure are not limited thereto.

Figure 1:
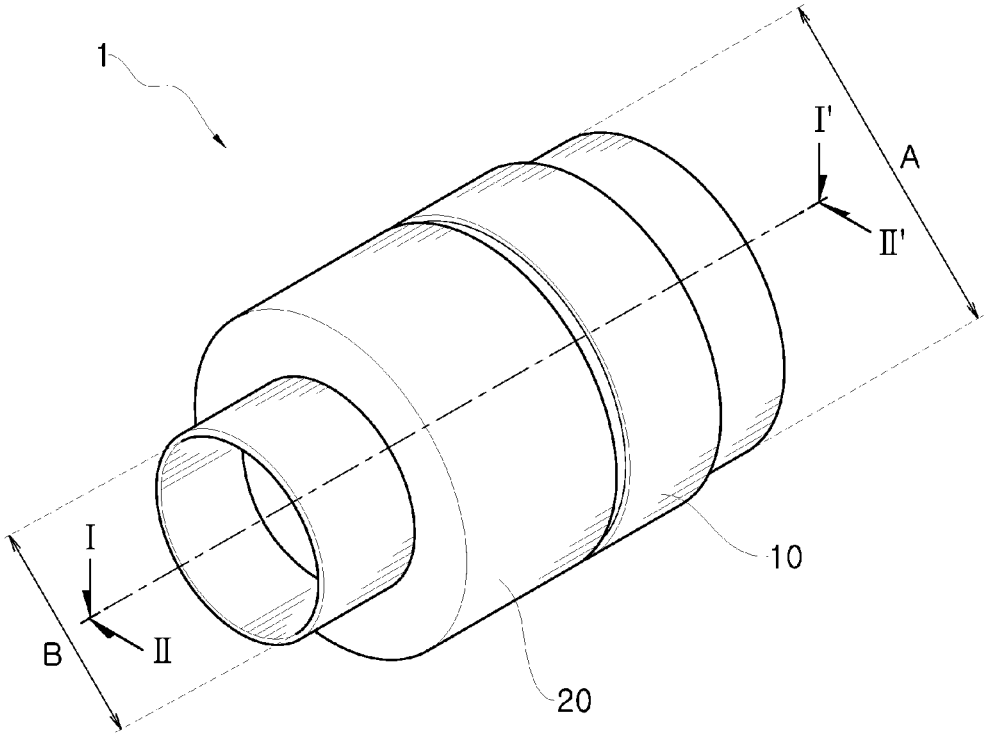
FIG. 1 is a perspective view showing a resonator according to the first embodiment of the present disclosure.
Figure 2A:
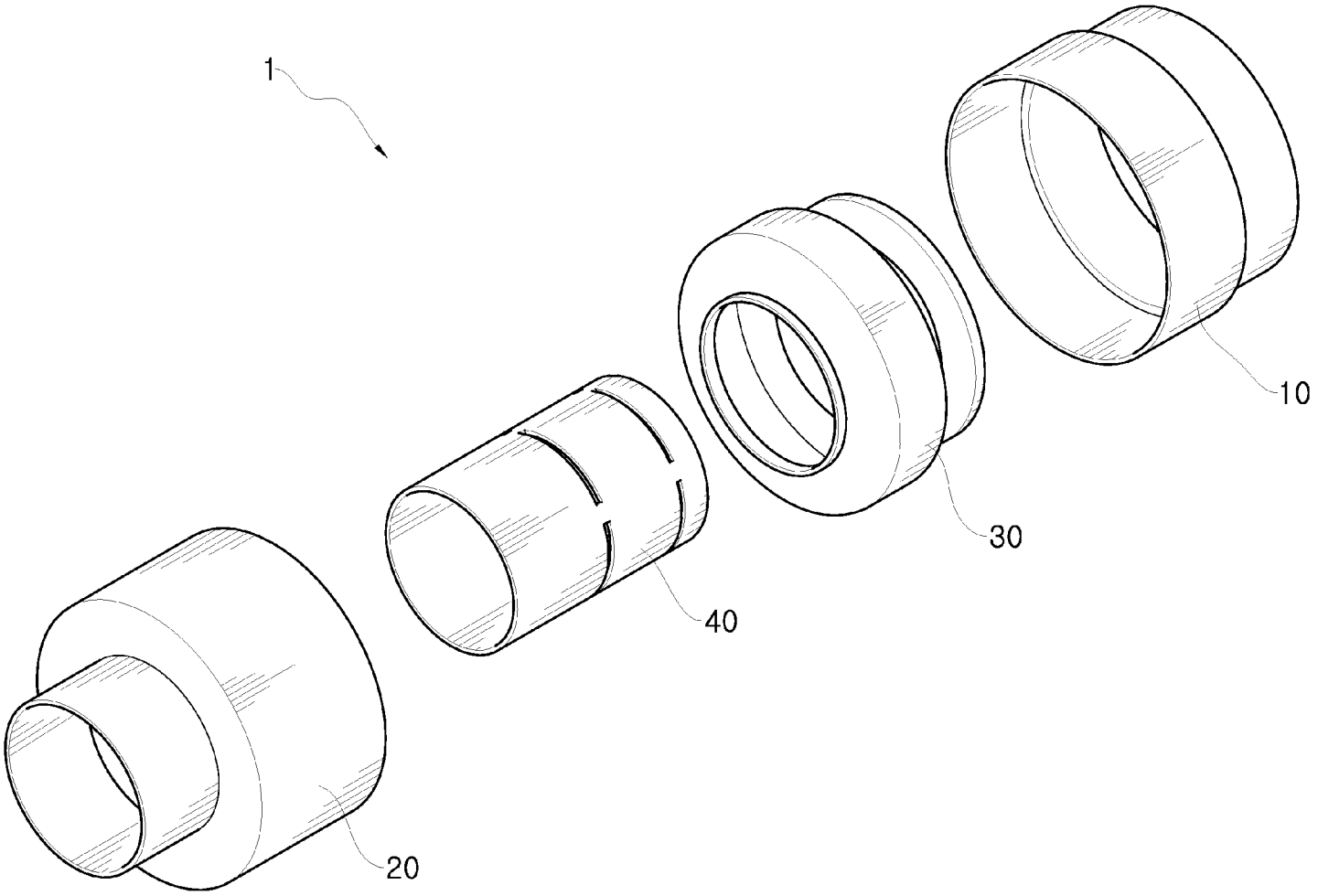
FIGS. 2A and 2B are exploded views showing an inner configuration of the resonator according to the first embodiment of the present disclosure.
Figure 2B:
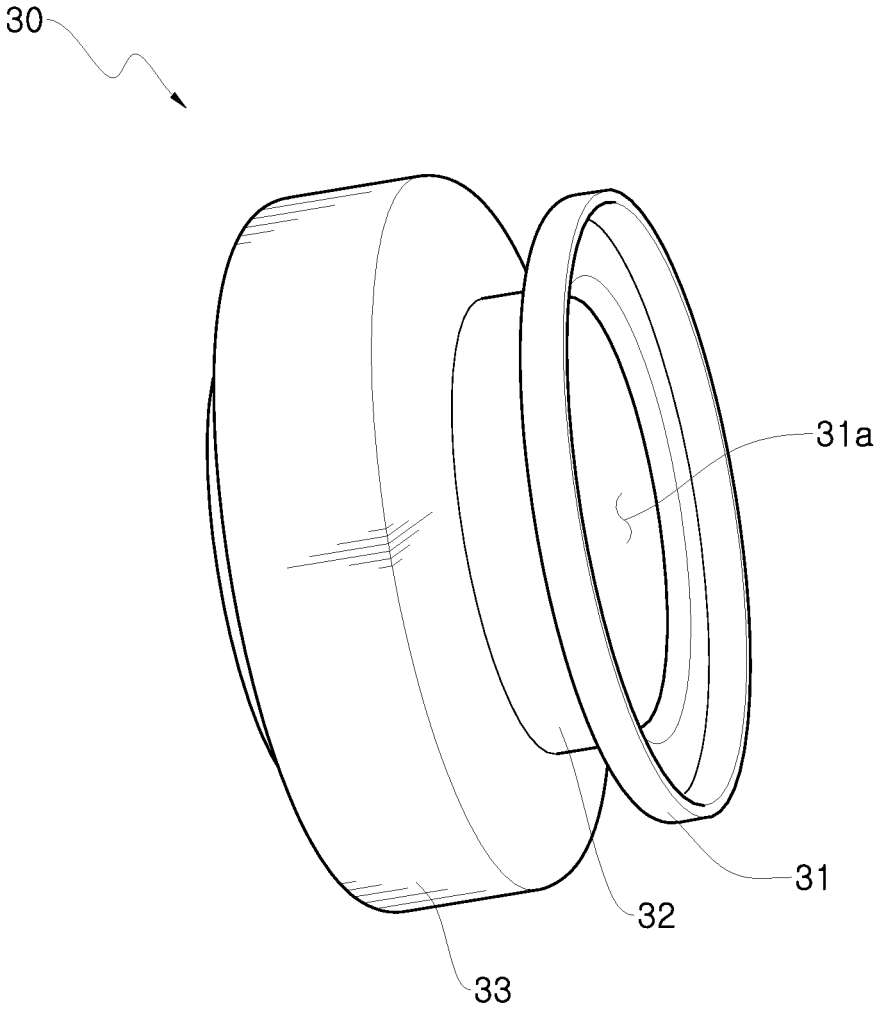
Figure 3:
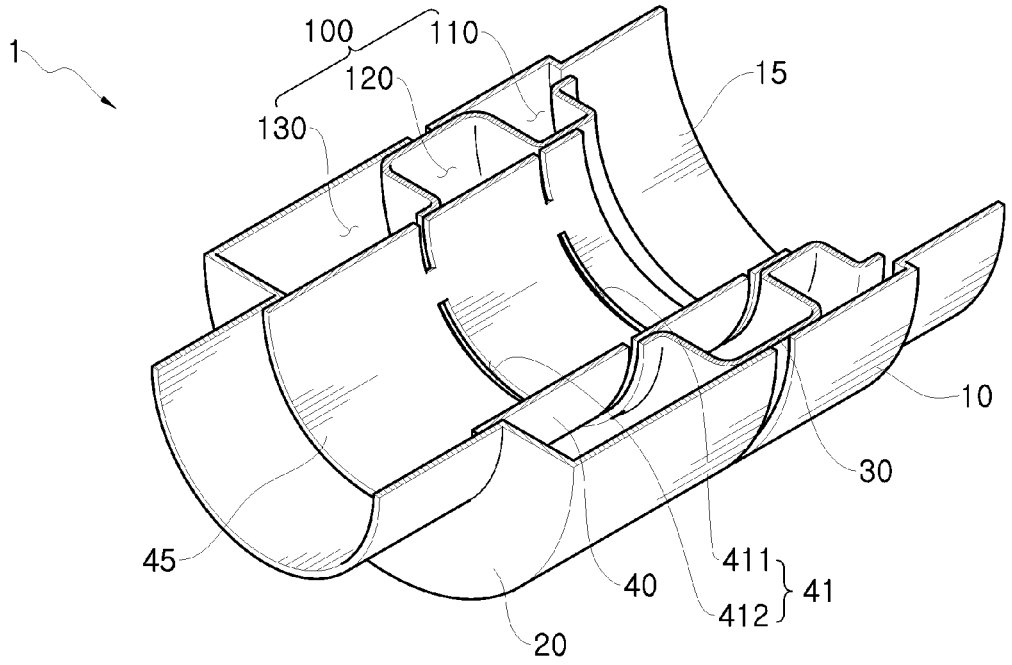
FIG. 3 is a cross-sectional view, taken along the line I-I' of FIG. 1.
Figure 4:
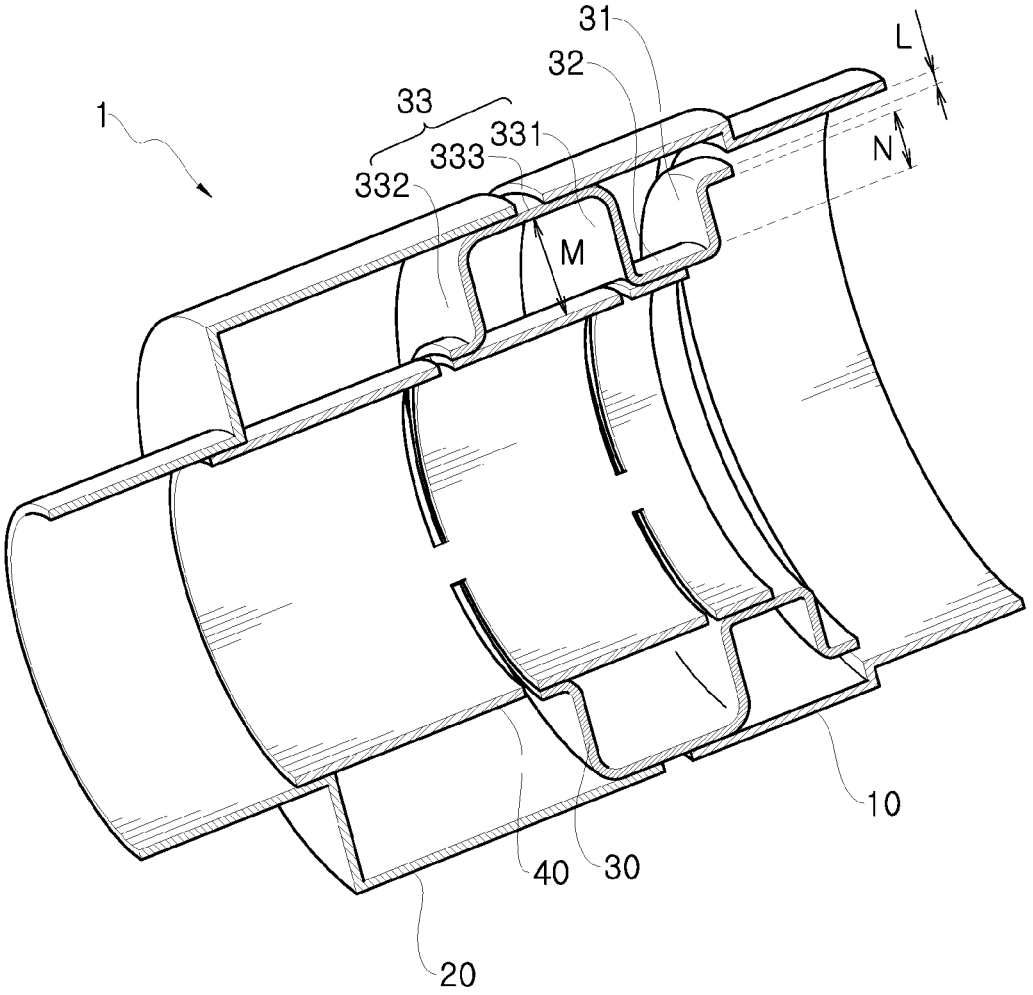
FIG. 4 is a cross-sectional view, taken along the line II-II' of FIG. 1.

FIG. 1 is a perspective view showing a resonator according to the first embodiment of the present disclosure, FIG. 2*a* is an exploded view showing a detailed configuration of the resonator, FIG. 2*b* is a perspective view showing an expansion pipe which is a component of the resonator, FIG. 3 is a cross-sectional view, taken along the line I-I' of FIG. 1, and FIG. 4 is a cross-sectional view, taken along the line II-II' of FIG. 1.

A resonator 1 according to the present disclosure includes a first outer pipe 10 configuring a part of an outward appearance and a second outer pipe 20 configuring another part of the outward appearance. An end diameter A of the first outer pipe 10 and an end diameter B of the second outer pipe 20 may be different from each other. For example, the end diameter A of the first outer pipe may be greater than the end diameter B of the second outer pipe. In addition, an end of the first outer pipe 10 may be an inlet 15 serving as an inflow passage of air, and an end of the second outer pipe 20 may be an outlet 45 serving as a discharge passage of air.

An inner pipe 40 may be inserted into an inner space of the first outer pipe 10 and the second outer pipe 20. At this time, if the end diameter A of the first outer pipe is 1.4 to 1.5 times of the end diameter B of the second outer pipe, the one end of the inner pipe 40 may not be easily coupled to any one of the outer pipes 10, 20.

Therefore, in this embodiment, an expansion pipe 30 may be inserted between the outer pipes 10, 20 and the inner pipe 40. In detail, the expansion pipe 30 may be inserted into the inner space of the outer pipes 10, 20, and the inner pipe 40 may be inserted into the inner space of the expansion pipe 30.

The expansion pipe 30 includes a first bent portion 31 having a hollow 31*a* for allowing air to pass, an internal coupling unit 32 coupled to the inner pipe 40, and a chamber forming unit 33 coupled to the outer pipes 10, 20. One end of the first bent portion 31 may be connected to the internal coupling unit 32, and the other end of the first bent portion 31 may be bent.

The first bent portion 31, the internal coupling unit 32 and the chamber forming unit 33 may be fabricated in an integrally coupled state. In other words, the expansion pipe 30 may be prepared by expanding through a mold during a part production stage.

The other end of the first bent portion 31 may be bent to a direction parallel to an extension direction of the first outer pipe 10. Therefore, the first bent portion 31 may be spaced apart from the first outer pipe 10 by a predetermined distance. In other words, the first bent portion 31 is disposed to be spaced apart from the first outer pipe 10 with an interval L serving as an air passage. In other words, the interval L giving an air passage is formed between the first bent portion 31 and the first outer pipe 10, and the air flowing into a resonance chamber 100 through the interval L may have reduced noise by means of frequency tuning.

The chamber forming unit 33 includes a second bent portion 331 bent to a direction perpendicular to the internal coupling unit 32 based on, the moving direction of air, an external coupling unit 333 connected to the second bent portion 331 in a perpendicular direction and coupled to the outer pipes 10, 20, and a third bent portion 332 bent to a direction perpendicular to the external coupling unit 333. A terminal of the third bent portion 332 may be bent for convenient fabrication so as to be easily coupled to the inner pipe 40.

Heights M of the second bent portion 331 and the third bent portion 332 may be relatively greater than a height N of the first bent portion 31. Therefore, the interval L serving as an air passage may be formed between the first bent portion 31 and the first outer pipe 10.

In an existing technique, if the inlet and the outlet have different diameters, an inclined portion should be formed to allow the inner pipe to be directly coupled to the outer pipe. However, in this embodiment, since the inner pipe 40 may be coupled to the outer pipes 10, 20 even though the expansion pipe 30 has no inclined portion, the resonator 1 may be easily fabricated. In addition, in an existing technique, a slit serving as an air passage should be formed in the inclined portion of the inner pipe, but this is a difficult work since the space for forming the slit is not sufficient.

However, in this embodiment, the interval L may be formed between the outer pipes 10, 20 and the expansion pipe 30 instead of the slit to give an air passage, and thus the resonator 1 may use its internal space more efficiently.

A plurality of slits 41 giving the same function as the interval L may be formed at the inner pipe 40. In detail, the plurality of slits 41 includes a first slit 411 disposed adjacent to the inlet based on the moving direction of air, and a second slit 412 disposed spaced apart from the first slit 411 by a predetermined distance.

In addition, the resonance chamber 100 for adjusting a frequency of external air is provided between the outer pipes 10, 20 and the inner pipe 40. The resonance chamber 100 is divided into a plurality of regions by the expansion pipe 30 inserted between the outer pipes 10, 20 and the inner pipe 40. In detail, the resonance chamber 100 includes a first resonance chamber 110 formed between the first bent portion 31 and the second bent portion 331, a second resonance chamber 120 formed between the second bent portion 331 and the third bent portion 332, and a third resonance chamber 130 formed among the third bent portion 332, the second outer pipe 20 and the inner pipe 40, based on the moving direction of air.

The first resonance chamber 110 communicates with the interval L, and the second resonance chamber 120 communicates with the first slit 411. In addition, the third resonance chamber 130 communicates with the second slit 412 for frequency tuning of air.

Hereinafter, a moving passage of external air passing through the resonator 1 and a method for coupling a plurality of pipes of the resonator 1 will be described.

Figure 5:
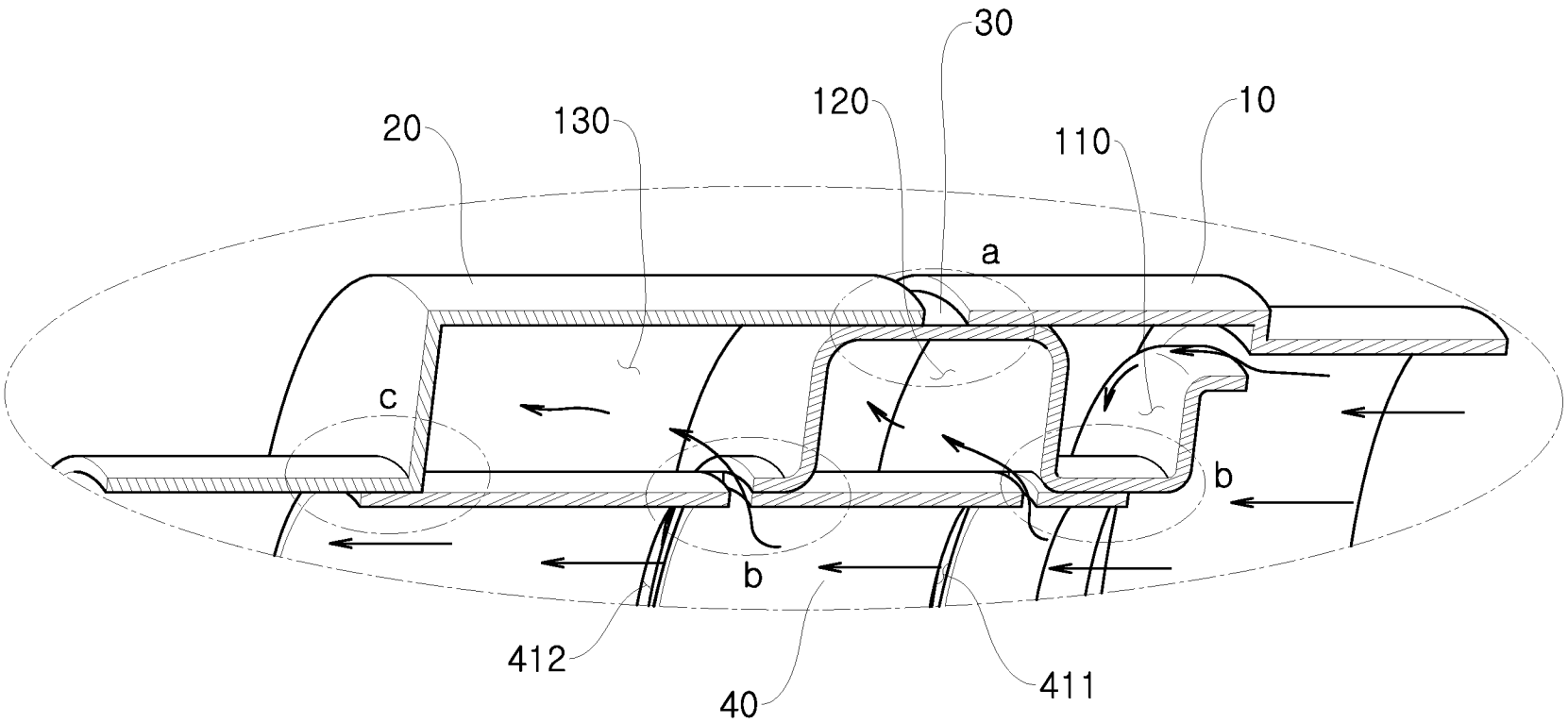
FIG. 5 is a diagram showing a flow of air passing through the resonator according to the first embodiment of the present disclosure.

FIG. 5 is a diagram showing a flow of air passing through the resonator according to the first embodiment of the present disclosure.

As shown in FIG. 5, the resonator 1 of this embodiment includes a plurality of pipes which are coupled to each other by welding. In detail, coupling (a) among the expansion pipe 30, the first outer pipe 10 and the second outer pipe 20, coupling (b) between the expansion pipe 30 and the inner pipe 40 and coupling (c) between the second outer pipe 20 and the inner pipe 40 are all performed by welding along a circumferential direction. Since the plurality of pipes are hermetically sealed by welding, it is possible to prevent a leakage of external air and thus maximize the efficiency of intake noise reduction.

Even though it has been illustrated in this embodiment that the plurality of pipes are coupled by welding, the present disclosure is not limited thereto, and another coupling method than welding may also be used as long as the plurality of pipes are hermetically coupled. If the plurality of pipes are hermetically coupled as described above, the resonator I for noise reduction is completely made as an assembly.

Meanwhile, an existing resonator has a limit in the number of resonance chambers. However, the resonator of this embodiment may easily tune a frequency, different from the existing structure.

However, in order to allow air having a high frequency to flow into the first resonance chamber 110, the size the plurality of pipes 10, 20, 30, 40 may be limited to a predetermined ratio.

Figure 6:
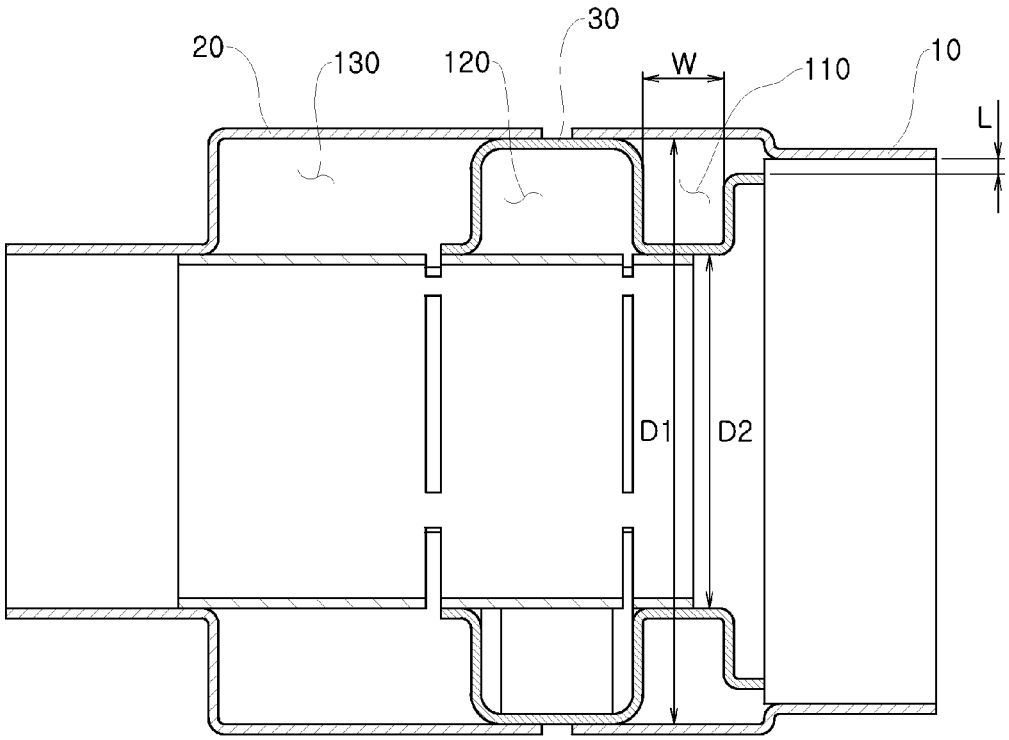
FIG. 6 is a diagram for illustrating a size of a plurality of pipes of a first resonance chamber and a size of an interval for guiding air to the first resonance chamber.

Referring to FIG. 6, the first resonance chamber 110 is formed as a space surrounded by a part of the first outer pipe 10, the first bent portion 31 spaced apart from the first outer pipe 10 by a predetermined distance, a second bent portion 331 extending in a direction parallel to the extending direction of the first bent portion 31, and the internal coupling unit 32 having one end connected to the first bent portion 31 and the other end connected to the second bent portion 331.

Design conditions for the first resonance chamber 110 capable of absorbing air with a high frequency are as follows.

First, a diameter D1 of the first outer pipe 10 is 1.4 to 1.6 times of a diameter D2 of the internal coupling unit 32. In addition, a height W of the internal coupling unit 32 is 0.3 times of a diameter D2 of the internal coupling unit 32. In addition, a width L of the interval is 0.04 to 0.12 times of the diameter D2 of the internal coupling unit 32.

Table 1 below shows the resonator 1 prepared using an exemplary ratio suitable for the above design conditions, and a maximum frequency of air absorbed into the first resonance chamber 110 is shown as an experimental example.

TABLE 1

| W/D2 | D1/D2 | L/D2 | maximum frequency of air absorbed to the first resonance chamber (Hz) |
|---|---|---|---|
| 0.3 | 1.4 | 0.08 | 3600 |
| | 1.5 | 0.08 | 4000 |
| | 1.6 | 0.08 | 4300 |

As shown in Table 1 above, the resonator 1 of this embodiment fabricated according to the above design conditions may absorb air with a high frequency of 3600 Hz to 4300 Hz. If the above design conditions for the first resonance chamber 110 are changed, it is impossible to absorb air with a high frequency. For example, if a ratio of W/D2 is changed to 0.2 as in Table 2 below, the maximum frequency of air absorbed to the first resonance chamber 110 decreases as follows.

TABLE 2

| W/D2 | D1/D2 | L/D2 | maximum frequency of air absorbed to the first resonance chamber (Hz) |
|---|---|---|---|
| 0.2 | 1.4 | 0.08 | 2800 |
| | 1.5 | 0.08 | 3000 |
| | 1.6 | 0.08 | 3200 |

If values of D1/D2 and L/D2 increase as in Table 2 above with W/D2 being 0.2, this accompanies overall structural changes or manufacturing problems of the resonator 1, and thus the maximum frequency of air absorbed to the first resonance chamber 110 may not have a value of 3600 Hz to 4300 Hz. In other words, the values of W/D2, D1/D2 and L/D2 shown in Table 1 may be regarded as optimal design conditions for absorbing air with a high frequency to the first resonance chamber 110.

Figure 7:
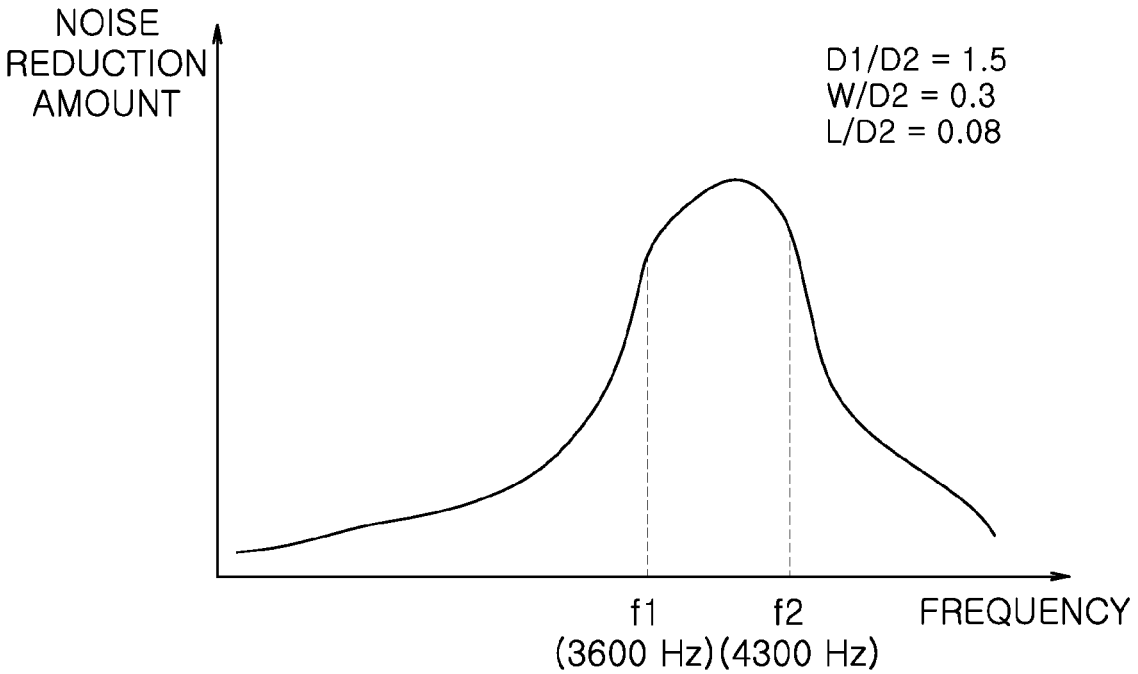
FIG. 7 is a graph showing a noise reduction amount according to a frequency of air moving to the first resonance chamber.

In FIG. 7, a noise reduction amount according to a frequency of air absorbed to the first resonance chamber 110 under design conditions with W/D2 of 0.3, D1/D2 of 1.5, and L/D2 of 0.08, which accord with the above conditions, is depicted with a graph. As shown in FIG. 7, since the resonance chamber for absorbing air with a maximum frequency of 3600 Hz to 4300 Hz is formed at the resonator 1 of the present disclosure, noise caused by air with the high frequency may be reduced. In addition, by changing the L/D2 value, frequency tuning for a low frequency region is also available.

Hereinafter, a moving pass of external air passing through the resonator 1 and a method for reducing intake noise will be described.

First, a part of air flowing into the inlet 15 passes through the interval L and moves to the first resonance chamber 110, and another part of the air flowing into the inlet 15 moves to the inner space of the resonator 1 formed by the inner pipe 40. The air flowing into the first resonance chamber 110 may be air with a high frequency as described above as an example. In other words, the first resonance chamber 110 may be a resonance chamber for tuning air with a high frequency and thus reducing noise.

Similarly, a part of air moving along the inner pipe 40 may pass the first slit 411 and another part of the air moving along the inner pipe 40 may pass the second slit 412, and both of them move to the second resonance chamber 120 and the third resonance chamber 130, respectively. The air flowing into the second resonance chamber 120 may be air with a relatively lower frequency in comparison to the air flowing into the first resonance chamber 110. In the same principle, the air flowing into the third resonance chamber 130 may be air with a relatively lower frequency in comparison to the air flowing into the second resonance chamber 120. Therefore, the air flowing into the inlet 15 moves to the first to third resonance chambers 110, 120, 130 depending on its frequency, and since the first to third resonance chambers 110, 120, 130 perform frequency tuning, the absorbed air discharges out through the outlet 45 with reduced noise. In this embodiment, since the air flowing in through the inlet 15 discharges out through the outlet 45, it is possible to reduce noise by performing frequency tuning in a direction where an air frequency region decreases, namely from a high frequency region to a low frequency region. As another example, it is also possible to reduce noise by performing frequency tuning in a direction where an air frequency region increases, namely from a low frequency region to a high frequency region, by changing dimensions of the resonator 1.

In this embodiment, in order to form a plurality of resonance chambers 100, a single expansion pipe 30 is inserted between the outer pipes 10, 20 and the inner pipe 40. Hereinafter, another example for forming the plurality of resonance chambers 100 will be described.

Figure 8:
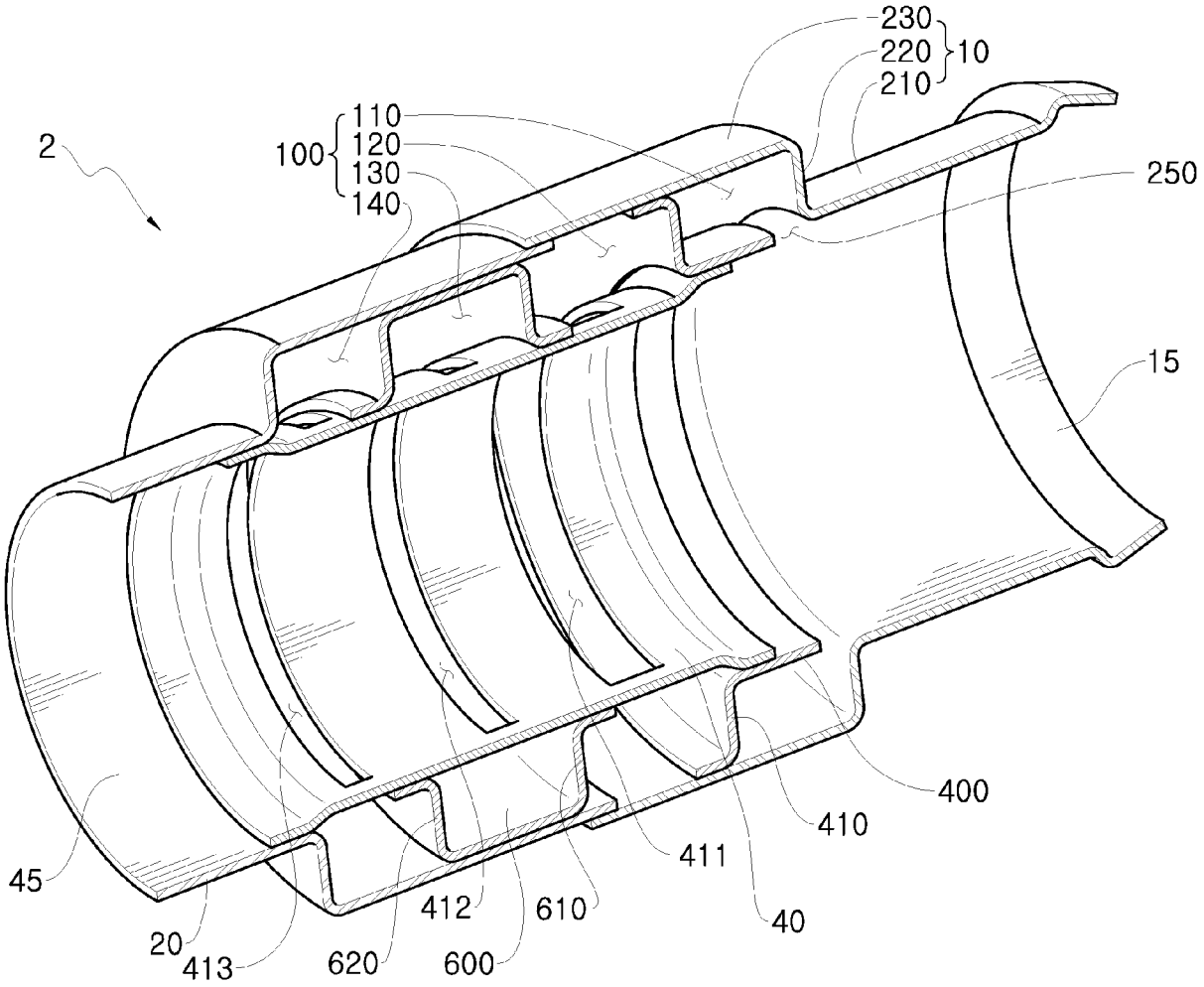
FIG. 8 is a cross-sectional view showing an inner configuration of a resonator according to the second embodiment of the present disclosure, observed from one side.
Figure 9:
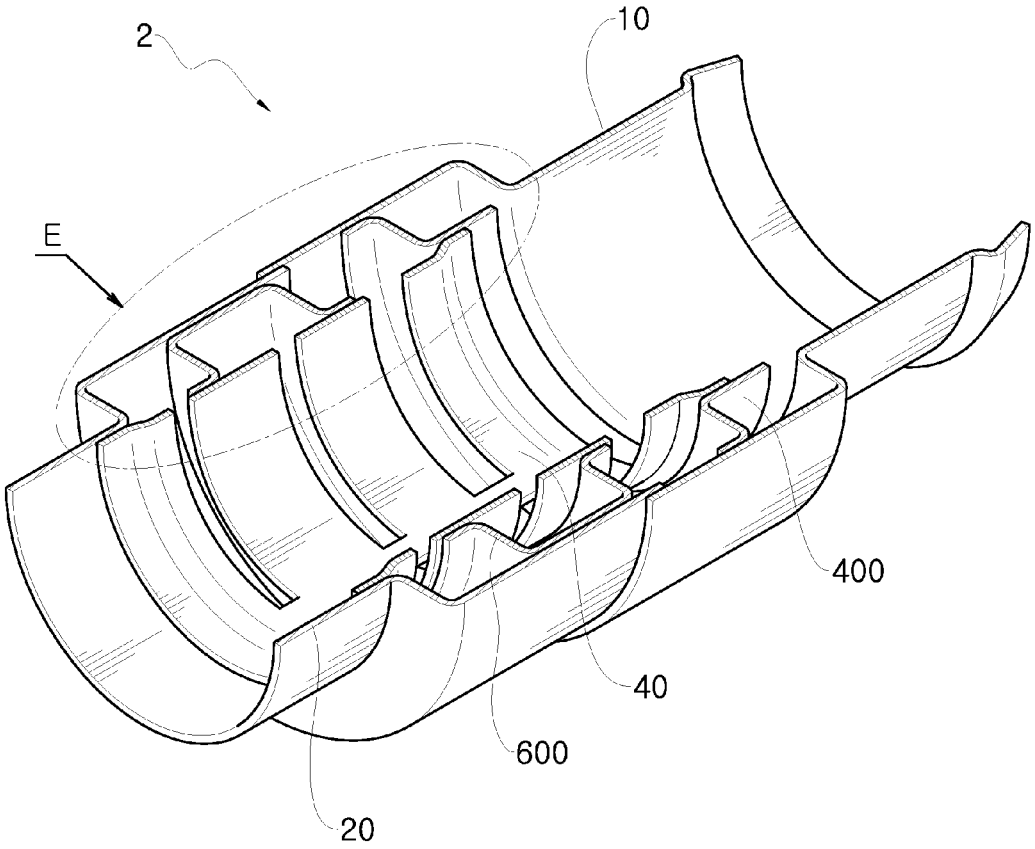
FIG. 9 is a cross-sectional view showing an inner configuration of the resonator according to the second embodiment of the present disclosure, observed from another side.

FIG. 8 is a cross-sectional view showing an inner configuration of a resonator according to the second embodiment of the present disclosure, observed from one side and FIG. 9 is a cross-sectional view showing an inner configuration of the resonator according to the second embodiment of the present disclosure, observed from another side.

Referring to FIGS. 8 and 9, in this embodiment, a plurality of expansion pipes 400, 600 are inserted between the outer pipes 10, 20 and the inner pipe 40, different from the former embodiment. In detail, the expansion pipes of this embodiment include an inflow expansion pipe 400 disposed adjacent to the inlet 15 and a discharge expansion pipe 600 disposed adjacent to the outlet 45.

One surface of the inflow expansion pipe 400 is coupled in contact with the inner pipe 40, and the other surface of the inflow expansion pipe 400 is coupled in contact with the first outer pipe 10. Therefore, an inflow bent portion 410 extending from the inner pipe 40 to the first outer pipe 10 is formed at the inflow expansion pipe 400. The resonance chamber 100 may be partitioned into a plurality of regions by the inflow bent portion 410.

A first discharge bent portion 610 extending from the inner pipe 40 to the second outer pipe 20 based on the moving direction of air and a second discharge bent portion 620 extending from the second outer pipe 20 to inner pipe 40 are formed at the discharge expansion pipe 600. Therefore, the resonance chamber 100 may be partitioned into a plurality of regions by the first discharge bent portion 610 and the second discharge bent portion 620. The inflow bent portion 410, the first discharge bent portion 610 and the second discharge bent portion 620 can be named as the first bent portion, the second bent portion and the third bent portion, respectively.

As a result, the resonance chamber 100 is partitioned into a plurality of regions by the inflow expansion pipe 400 and the discharge expansion pipe 600. In detail, the resonance chamber 100 may be divided into a first resonance chamber 110, a second resonance chamber 120, a third resonance chamber 130 and a fourth resonance chamber 140, respectively, based on the moving direction of air. The first resonance chamber 110 is a space formed between the inflow expansion pipe 400 and the first outer pipe 10, and the second resonance chamber 120 is a space formed by the first outer pipe 10, the first discharge bent portion 610, the inner pipe 40 and the inflow bent portion 410. In addition, the third resonance chamber 130 is a space formed between the discharge expansion pipe 600 and the inner pipe 40, and the fourth resonance chamber 140 is a space formed by the second outer pipe 20, the inner pipe 40 and the second discharge bent portion 620.

The second to fourth resonance chambers 120, 130, 140 communicate with the first to third slits 411, 412, 413 formed at the inner pipe 40. Therefore, the air flowing into the inner pipe 40 through the inlet 15 moves to the second to fourth resonance chambers 120, 130, 140 through the first to third slits 411, 412, 413 and experiences frequency tuning.

The first outer pipe 10 is formed by integrally coupling an inflow guide unit 210 for guiding a moving path of air flowing into the inlet 15 and a chamber partitioning unit 230 having a relatively greater diameter than the inflow guide unit 210. The inflow guide unit 210 and the chamber partitioning unit 230 are integrally fabricate by an extension 220 which extends in a radial direction to connect the inflow guide unit 210 and the chamber partitioning unit 230. In other words, one side of the extension 220 is connected to the inflow guide unit 210, and the other side of the extension 220 is connected to the chamber partitioning unit 230.

A gap 250 for giving a moving path of air is formed between the inflow expansion pipe 400 and the extension 220 of the first outer pipe 10. In other words, a predetermined space allowing movement of external air is formed between one side of the inflow expansion pipe 400 and the first outer pipe 10. The air flowing into the inlet 15 passes through the gap 250 and moves to the first resonance chamber 110. Therefore, the gap 250 plays the same role as the plurality of slits 411, 412, 413 formed at, the inner pipe 40.

Hereinafter, a moving path of external air passing through the resonator 2 of this embodiment and welding locations of the plurality of pipes of the resonator 2 will be described.

Figure 10:
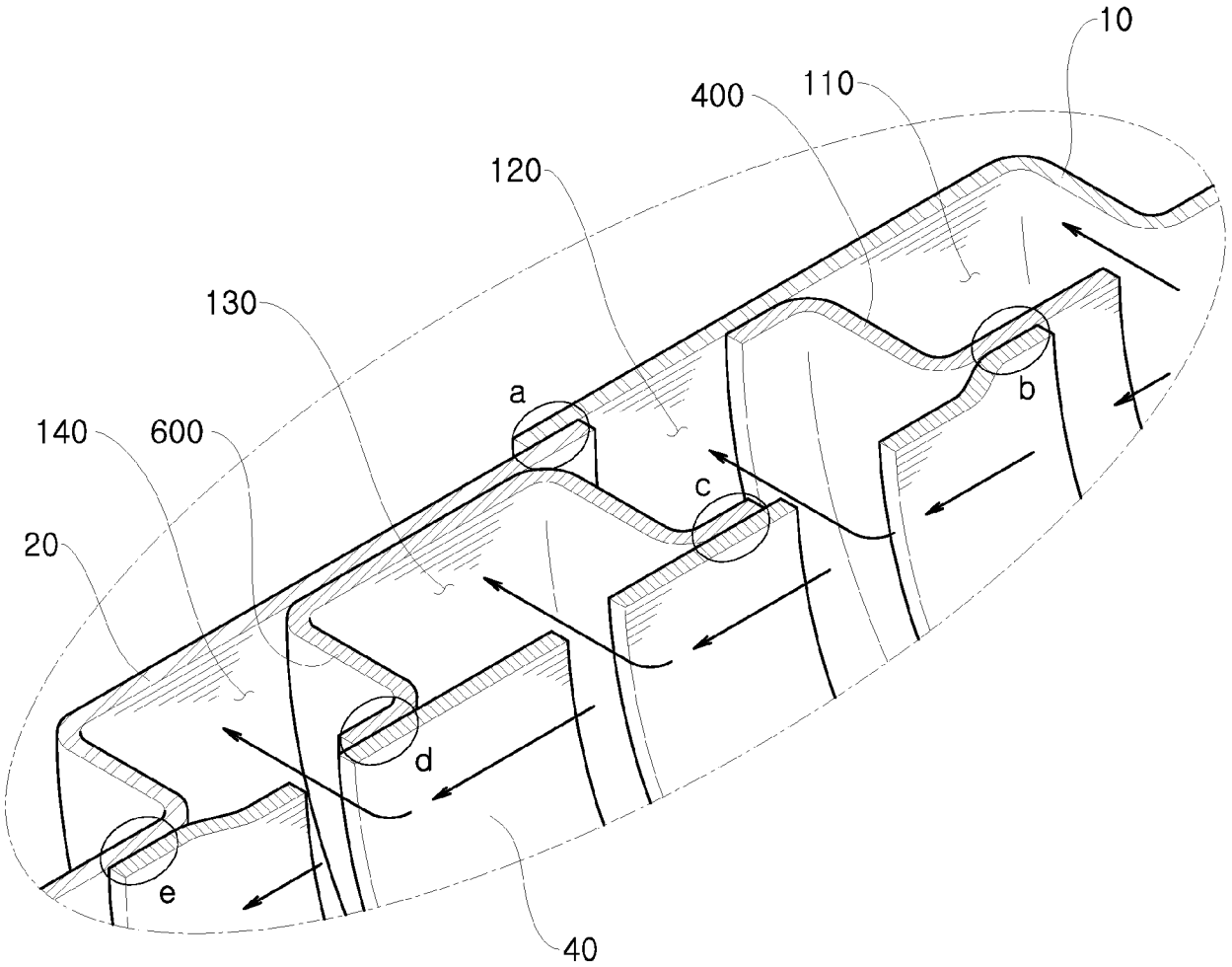
FIG. 10 is an enlarged view showing the portion E of FIG. 9, in which a flow of air passing through the resonator according to the second embodiment of the present disclosure is depicted.

FIG. 10 is an enlarged view showing the portion E of FIG. 9, in which a flow of air passing through the resonator according to the second embodiment of the present disclosure is depicted.

As shown in FIG. 10, in the resonator 2 of this embodiment, the plurality of pipes are coupled to each other by welding. In detail, coupling (a) between the first outer pipe 10 and the second outer pipe 20, coupling (b) between the inflow expansion pipe 400 and the inner pipe 40, coupling (c, d) between the discharge expansion pipe 600 and the inner pipe 40 and coupling (e) between the second outer pipe 20 and the inner pipe 40 are all performed by welding. Since the plurality of pipes are hermetically sealed by welding, it is possible to prevent a leakage of external air and thus maximize the efficiency of intake noise reduction.

Even though it has been illustrated in this embodiment that the plurality of pipes are coupled by welding, the present disclosure is not limited thereto, and another coupling method than welding may also be used as long as the plurality of pipes are hermetically coupled.

If the plurality of pipes are hermetically coupled as described above, the resonator 2 for noise reduction is completely made as an assembly. Hereinafter, a moving path of external air passing through the resonator 2 and a method for reducing intake noise will be described.

First, a part of air flowing into the inlet 15 passes through the gap 250 and moves to the first resonance chamber 110, and another part of the air flowing into the inlet 15 moves to the inner pipe 40. The air flowing into the first resonance chamber 110 may be air with a high frequency as an example. In other words, the first resonance chamber 110 may be a resonance chamber for tuning air with a high frequency and thus reducing noise.

Similarly, a part of air moving along the inner pipe 40 may pass the first slit 411, another part of the air moving along the inner pipe 40 may pass the second slit 412, and still another part of the air moving along the inner pipe 40 may pass the third slit 413. All of them move to the second resonance chamber 120, the third resonance chamber 130, and the fourth resonance chamber 140, respectively. The air flowing into the second resonance chamber 120 may be air with a relatively lower frequency in comparison to the air flowing into the first resonance chamber 110. In the same principle, the air flowing into the third resonance chamber 130 may be air with a relatively lower frequency in comparison to the air flowing into the second resonance chamber 120, and the air flowing into the fourth resonance chamber 140 may be air with a relatively lower frequency in comparison to the air flowing into the third resonance chamber 130.

Therefore, the air flowing into the inlet 15 moves to the first to fourth resonance chambers 110, 120, 130, 140 depending on its frequency, and since the first to fourth resonance chambers 110, 120, 130, 140 perform frequency tuning, the absorbed air discharges out through the outlet 45 with reduced noise.

Even though it has been illustrated in this embodiment that the frequency of air flowing into the resonance chamber 100 gradually decreases from the first resonance chamber 110 to the fourth resonance chamber 140, the present disclosure is not limited thereto. For example, the third resonance chamber 130 and the fourth resonance chamber 140 may be resonance chambers for tuning air with a high frequency, and the first resonance chamber 110 and the second resonance chamber 120 may be resonance chambers for tuning air with a low frequency.

In addition, the air flowing into the resonance chamber 100 may have different frequencies depending on various factors such as a thickness of the expansion pipe 400, 600, a horizontal length of the expansion pipes 400, 600, a volume of each resonance chamber 100, a width of the gap 250 or the slits 411, 412, 413 serving as an air passage, or the like. However, if the number of the resonance chambers 100 increases, air with various frequencies may flow into each resonance chamber, and thus noise of a broad frequency band may be reduced.

Figure 11:
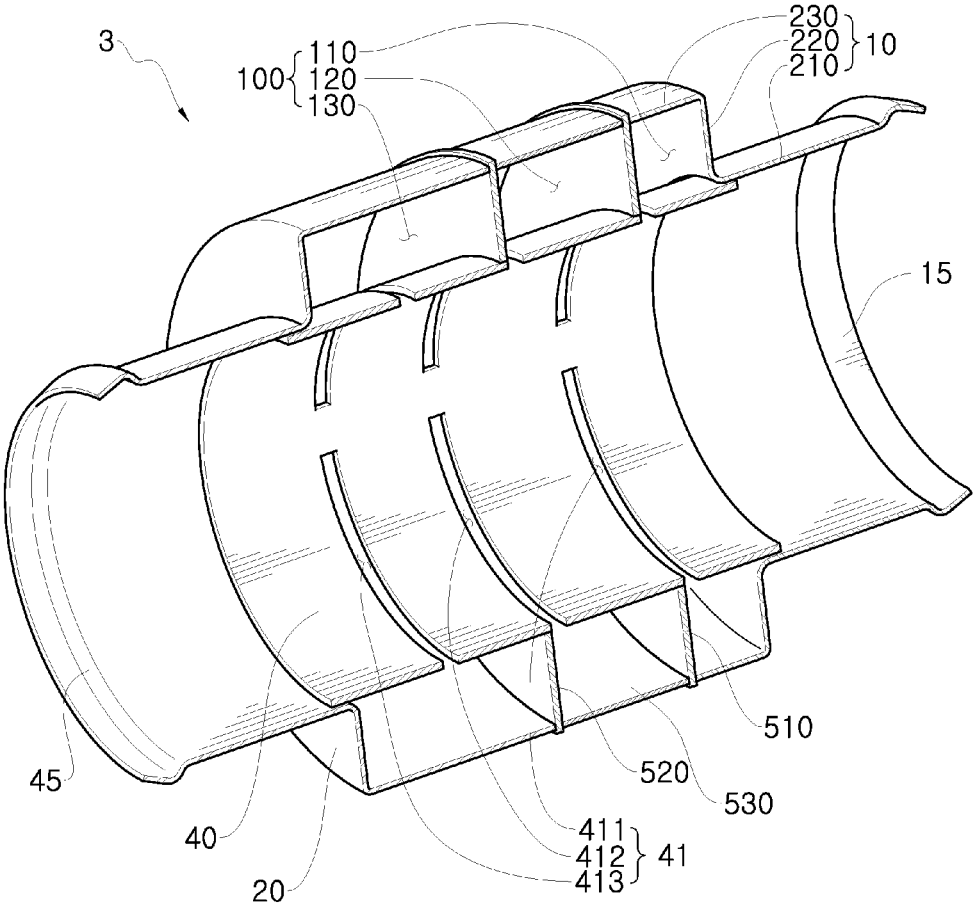
FIG. 11 is a cross-sectional view showing an inner configuration of a resonator according to the third embodiment of the present disclosure, observed from one side.
Figure 12:
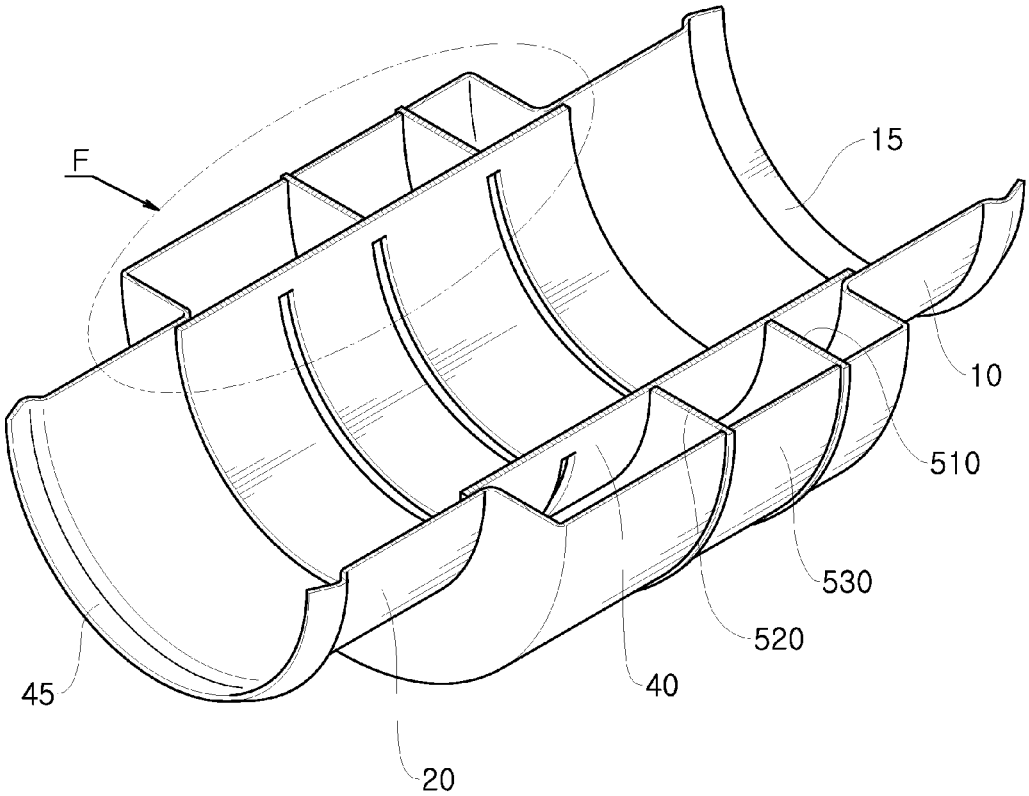
FIG. 12 is a cross-sectional view showing an inner configuration of the resonator according to the third embodiment of the present disclosure, observed from another side.

FIG. 11 is a cross-sectional view showing an inner configuration of a resonator according to the third embodiment of the present disclosure, observed from one side, and FIG. 12 is a cross-sectional view showing an inner configuration of the resonator according to the third embodiment of the present disclosure, observed from another side.

Referring to FIGS. 11 and 12, in this embodiment, in order to increase the number of the resonance chambers 100, barriers 510, 520 and an intermediate pipe 530 are inserted between the outer pipes 10, 20 and the inner pipe 40, different from the former embodiments (the first and second embodiments of the present disclosure). In detail, a resonator 3 of this embodiment includes a first outer pipe 10 having the inlet 15 serving as an inflow passage of external air and a second outer pipe 20 having the outlet 45 serving as a discharge passage of external air. The intermediate pipe 530 extending in a length direction is disposed between the first outer pipe 10 and the second outer pipe 20. Therefore, the first outer pipe 10, the second outer pipe 20 and the intermediate pipe 530 form an outward appearance of the resonator 3 of this embodiment.

The first outer pipe 10 may be classified into an inflow guide unit 210, an extension 220 and a chamber partitioning unit 230, which may be integrally fabricated, similar to the second embodiment of the present disclosure.

The inner pipe 40 having a plurality of slits 41 is inserted into the inner space of the outer pipes 10, 20. As shown in FIG. 11, the slits formed at the inner pipe 40 may be a first slit 411, a second slit 412 and a third slit 413, respectively, based on the moving direction of air.

The first barrier 510 is disposed between the first outer pipe 10 and the intermediate pipe 530, and the second barrier 520 is disposed between the intermediate pipe 530 and the second outer pipe 20. In other words, the first barrier 510 is disposed at one side of the intermediate pipe 530, and the second barrier 520 is disposed at the other side of the intermediate pipe 530. In this embodiment, the barrier has been illustrated as being classified into the first barrier 510 and the second barrier 520, but the number of the barriers 510, 520 is not limited thereto.

The first barrier 510 and the second barrier 520 are arranged side by side in a direction parallel to the extension 220 of the first outer pipe 10. In other words, the first barrier 510 and the second barrier 520 may extend in a direction perpendicular to the intermediate pipe 530.

In addition, an outer circumference of the barriers 510, 520 may be exposed outwards. In detail, an outer surface of the resonator 3 may be configured with the first outer pipe 10, the first barrier 510, the intermediate pipe 530, the second barrier 520 and the second outer pipe 20, based on the moving direction of air. However, the first outer pipe 10, the intermediate pipe 530 and the second outer pipe 20 may be integrally fabricated, and the barriers 510, 520 may be attached to an inner side of the outer surface of the resonator 3 integrally fabricated.

The resonance chamber 100 for adjusting a frequency of external air is formed in the space between the outer pipes 10, 20 and the inner pipe 40 and the space between the intermediate pipe 530 and the inner pipe 40. The resonance chamber 100 is divided into a plurality of regions by the barriers 510, 520.

In detail, the resonance chamber 100 is divided into a first resonance chamber 110, a second resonance chamber 120 and a third resonance chamber 130, respectively, based on the moving direction of air. The first resonance chamber 110 is a space formed among the first outer pipe 10, the first barrier 510 and the inner pipe 40, and the second resonance chamber 120 is a space formed by the first barrier 510, the intermediate pipe 530, the second barrier 520 and the inner pipe 40. In addition, the third resonance chamber 130 is a space formed among the second barrier 520, the second outer pipe 20 and the inner pipe 40.

In this embodiment, the resonance chamber 100 is divided into three chambers by two barriers 510, 520, but the present disclosure is not limited thereto. For example, if three barriers are disposed in the resonance chamber 100, the resonance chamber 100 may be divided into four chambers.

The first to third resonance chambers 110, 120, 130 communicate with the first to third slits 411, 412, 413 formed at the inner pipe 40. Therefore, the air flowing into the inner pipe 40 through the inlet 15 moves to the first to third resonance chambers 110, 120, 130 through the first to third slits 411, 412, 413, thereby performing frequency tuning for the absorbed air.

Hereinafter, a moving path of external air passing through the resonator 3 and welding locations of the plurality of 10, 20, 40, 530 and barriers 510, 520 of the resonator 3 will be described.

Figure 13:
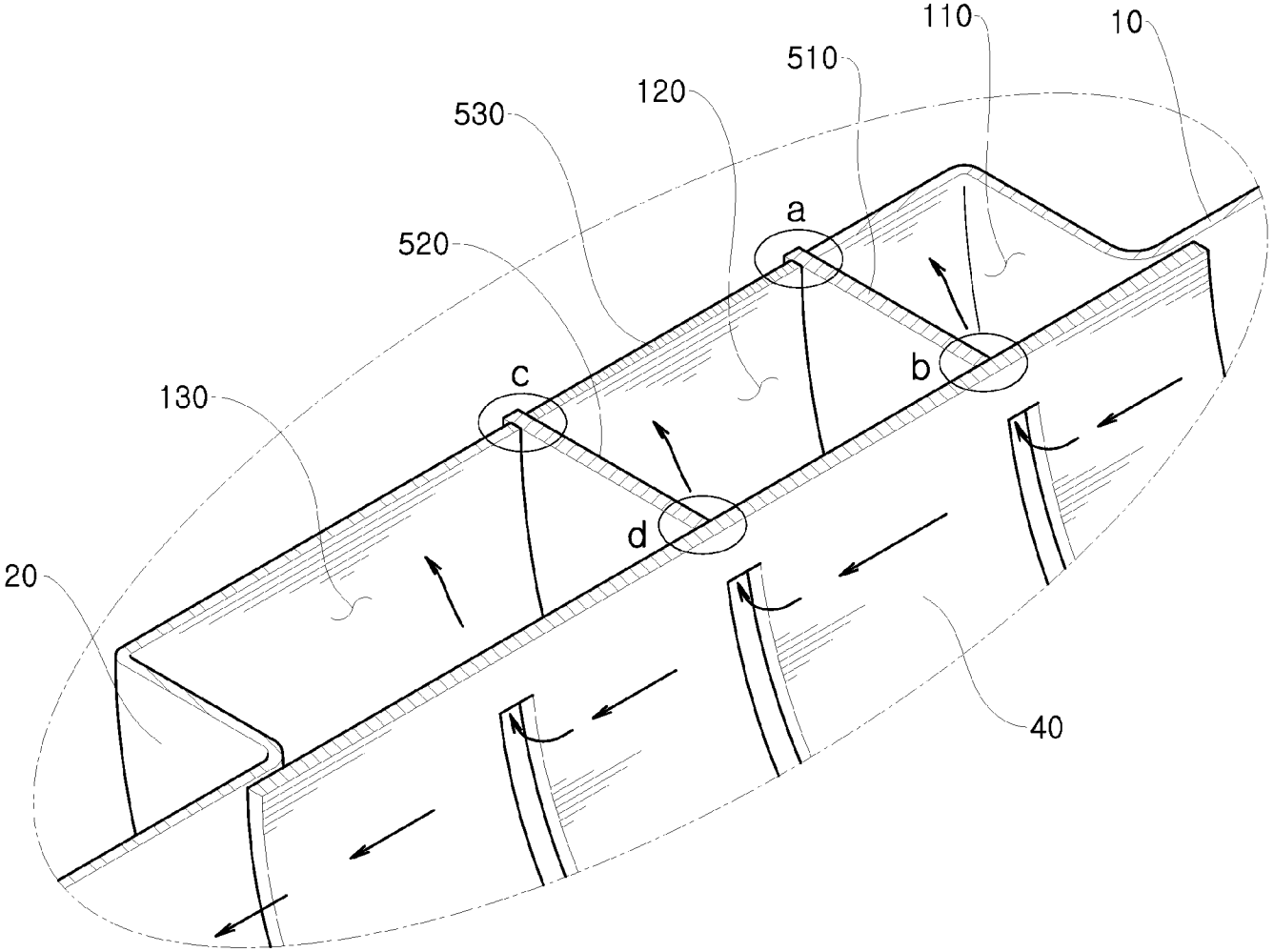
FIG. 13 is an enlarged view showing the portion F of FIG. 12, in which a flow of air passing through the resonator according to the third embodiment of the present disclosure is depicted.

FIG. 13 is an enlarged view showing the portion F of FIG. 12, in which a flow of air passing through the resonator according to the third embodiment of the present disclosure is depicted.

As shown in FIG. 13, in the resonator 3 of this embodiment, the plurality of pipes 10, 20, 40, 530 and the barriers 510, 520 are coupled to each other by welding. In detail, coupling (a) between the first outer pipe 10 and the first barrier 510, coupling (b) between the inner pipe 40 and the first barrier 510, coupling (c) between the intermediate pipe 530 and the second barrier 520 and coupling (d) between the second barrier 520 and the inner pipe 40 are all performed by welding. Since the plurality of pipes are hermetically sealed by welding, it is possible to prevent a leakage of external air and thus maximize the efficiency of intake noise reduction.

Even though it has been illustrated in this embodiment that the plurality of pipes are coupled by welding, the present disclosure is not limited thereto, and another coupling method than welding may also be used as long as the plurality of pipes are hermetically coupled.

If the plurality of pipes are hermetically coupled as described above, the resonator 3 for noise reduction is completely made as an assembly. Hereinafter, a moving path of external air passing through the resonator 3 and a method for reducing intake noise will be described.

First, a part of air flowing into the inlet 15 passes through the first slit 411 and moves to the first resonance chamber 110, and another part of the air flowing into the inlet 15 moves to the inner pipe 40. The air flowing into the first resonance chamber 110 may be air with a high frequency as an example. In other words, the first resonance chamber 110 may be a resonance chamber for tuning air with a high frequency and thus reducing noise.

Similarly, a part of air moving along the inner pipe 40 passes the second slit 412 and moves to the second resonance chamber 120, and another part of the air moving along the inner pipe 40 passes the third slit 413 and moves to the third resonance chamber 130. The air flowing into the second resonance chamber 120 may be air with a relatively lower frequency in comparison to the air flowing into the first resonance chamber 110. In the same principle, the air flowing into the third resonance chamber 130 may be air with a relatively lower frequency in comparison to the air flowing into the second resonance chamber 120. Therefore, the air flowing into the inlet 15 moves to the first to third resonance chambers 110, 120, 130 depending on its frequency, and since the first to third resonance chambers 110, 120, 130 perform frequency tuning, the absorbed air discharges out through the outlet 45 with reduced noise.

Even though it has been illustrated in this embodiment that the frequency of air flowing into the resonance chamber 100 gradually decreases from the first resonance chamber 110 to the third resonance chamber 130, the present disclosure is not limited thereto. For example, the second resonance chamber 120 and the third resonance chamber 130 may be resonance chambers for tuning air with a high frequency, and the first resonance chamber 110 may be resonance chambers for tuning air with a low frequency.

In addition, the air flowing into the resonance chamber 100 may have different frequencies depending on various factors such as a thickness of the barriers 510, 520, locations of the barriers 510, 520, a volume of each resonance chamber 100, a width of the slits 411, 412, 413, or the like. However, if the number of the resonance chambers 100 increases, air with various frequencies may flow into each resonance chamber, and thus noise of a broad frequency band may be reduced.

While the exemplary embodiments have been shown and described, it will be understood by those skilled in the art that various changes in form and details may be made thereto without departing from the spirit and scope of the present disclosure as defined by the appended claims. In addition, many modifications can be made to adapt a particular situation or material to the teachings of the present disclosure without departing from the essential scope thereof. Therefore, it is intended that the present disclosure not be limited to the particular exemplary embodiments disclosed as the best mode contemplated for carrying out the present disclosure, but that the present disclosure will include all embodiments falling within the scope of the appended claims.

What is claimed is:

1. A resonator for a vehicle, which reduces intake noise by using a resonance chamber for frequency tuning, the resonator comprising:

an outer pipe having a first outer pipe with an inlet for introducing external air and a second outer pipe with an outlet for discharging the air introduced into the inlet to outside;

an inner pipe disposed inside the outer pipe and having a plurality of slits for giving a passage of air; and an expansion pipe inserted between the outer pipe and the inner pipe to partition a space between the outer pipe and the inner pipe into a plurality of spaces and thus partition the resonance chamber into a plurality of regions, wherein the expansion pipe comprises:

an internal coupling unit coupled to the inner pipe;

an external coupling unit coupled to the outer pipe; and a plurality of bent portions extending in a direction perpendicular to the inner pipe and the outer pipe, and wherein the plurality of bent portions comprises:

a first bent portion disposed adjacent to the inlet and having one end connected to the internal coupling unit in a perpendicular direction;

a second bent portion having one end connected to the internal coupling unit in a perpendicular direction and the other end connected to the external coupling unit in a perpendicular direction; and a third bent portion disposed adjacent to the outlet and having one end connected to the external coupling unit in a perpendicular direction.

2. The resonator for a vehicle according to claim 1, wherein there is provided just a single expansion pipe, and wherein one end of the expansion pipe is disposed to be spaced apart from the outer pipe by a predetermined distance to form an interval serving as a passage of air.

3. The resonator for a vehicle according to claim 1, wherein a terminal of the first bent portion is bent to a direction parallel to an extension direction of the first outer pipe so that the first outer pipe and the first bent portion are disposed to be spaced apart from each other by a predetermined distance, and wherein a terminal of the third bent portion is bent to a direction parallel to a length direction of the inner pipe for coupling with the inner pipe.

4. The resonator for a vehicle according to claim 1, wherein the plurality of slits include a first slit disposed adjacent to the inlet and a second slit spaced apart from the first slit by a predetermined distance based on the moving direction of air, and wherein the resonance chamber includes a first resonance chamber communicating with the interval, a second resonance chamber communicating with the first slit and a third resonance chamber communicating with the second slit.

5. The resonator for a vehicle according to claim 4, wherein the outer pipe configuring one surface of the first resonance chamber has a diameter, which is 1.4 to 1.6 times of a diameter of the internal coupling unit.

6. The resonator for a vehicle according to claim 4, wherein the internal coupling unit has a height, which is 0.3 times of a diameter of the internal coupling unit.

7. The resonator for a vehicle according to claim 4, wherein the interval has a width, which is 0.04 to 0.12 times of a diameter of the internal coupling unit.

8. The resonator for a vehicle according to claim 1, wherein the outer pipe, the inner pipe and the expansion pipe are coupled by means of welding for hermetical sealing.

9. The resonator for a vehicle according to claim 1, wherein the expansion pipe includes:

an inflow expansion pipe having the first bent portion extending from the inner pipe to the first outer pipe based on the moving direction of air; and a discharge expansion pipe having the second bent portion and the third bent portion which connect the inner pipe to the second outer pipe.

10. The resonator for a vehicle according to claim 9, wherein the outer pipe has an extension extending in a radial direction perpendicular to the moving direction of air, and wherein a gap serving as a passage of air is formed between one side of the inflow expansion pipe and the extension.

11. The resonator for a vehicle according to claim 9, wherein the resonance chamber includes:

a first resonance chamber formed between the first outer pipe and the first bent portion;

a second resonance chamber formed between the first bent portion and the second bent portion;

a third resonance chamber formed between the second bent portion and the third bent portion; and a fourth resonance chamber formed between the third bent portion and the second outer pipe.

12. The resonator for a vehicle according to claim 9, wherein the outer pipe, the inner pipe, the inflow expansion and the discharge expansion pipe are coupled by means of welding for hermetical sealing.

* * * * *